US009282804B2

(12) United States Patent
Simonian et al.

(10) Patent No.: US 9,282,804 B2
(45) Date of Patent: Mar. 15, 2016

(54) MASCARA APPLICATOR SYSTEM

(71) Applicant: PEP INNOVATIONS, INC., Las Vegas, NV (US)

(72) Inventors: Christopher H. Y. Simonian, Sherman Oaks, CA (US); Jeannine Simonian, Sherman Oaks, CA (US); Ian J. Fettes, June Lake, CA (US)

(73) Assignee: PEP INNOVATIONS, INC., Las Vegas, NV (US)

( * ) Notice: Subject to any disclaimer, the term of this patent is extended or adjusted under 35 U.S.C. 154(b) by 481 days.

(21) Appl. No.: 13/776,147

(22) Filed: Feb. 25, 2013

(65) Prior Publication Data

US 2013/0223915 A1 Aug. 29, 2013

Related U.S. Application Data

(60) Provisional application No. 61/602,551, filed on Feb. 23, 2012.

(51) Int. Cl.
*A45D 40/26* (2006.01)
*A46B 13/02* (2006.01)

(52) U.S. Cl.
CPC ..... *A45D 40/262* (2013.01); *A45D 40/265* (2013.01); *A46B 13/02* (2013.01); *A46B 2200/1053* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,056,111 | A * | 11/1977 | Mantelet | 132/218 |
| 6,565,276 | B1 * | 5/2003 | Diaz | 401/129 |
| 7,654,271 | B2 * | 2/2010 | Wyatt et al. | 132/218 |
| 8,245,714 | B2 * | 8/2012 | Malvar et al. | 132/118 |
| 8,303,205 | B2 * | 11/2012 | Luo | 401/126 |

* cited by examiner

*Primary Examiner* — David Walczak
(74) *Attorney, Agent, or Firm* — David L. Hoffman; Hoffman Patent Group

(57) ABSTRACT

A cosmetic applicator system for mascara which is compatible with a wide variety of traditional mascara applicators and provides automated movement of the applicator to facilitate applying the mascara. Embodiments of the present invention may include an applicator system configured to receive and retain a wide variety of mascara applicators (e.g., brushes) and/or mascara container caps. The present invention may also include a motor which may provide all or a combination of rotation, oscillation, or vibration movement of the mascara applicator, and buttons or other means for actuating the motor, controlling the rotational direction of the motor, and the speed of the rotation, oscillation, or vibration. Alternatively, or in addition, cam surfaces are used to translate the rotation into oscillation.

20 Claims, 15 Drawing Sheets

MASCARA APPLICATOR SYSTEM

CROSS REFERENCE TO RELATED APPLICATION(S)

This application claims priority from U.S. Provisional Patent Application Ser. No. 61/602,551 filed Feb. 23, 2012, and which is incorporated by reference herein.

BACKGROUND OF THE INVENTION

1. Field of the Invention

The present invention relates to cosmetic applicators. In particular, exemplary embodiments of the invention relate to an electric mascara applicator system which provides motorized movement to mascara applicators which is compatible with a wide variety of traditional mascara applicators.

2. Description of the Related Art

Various types of cosmetic applicators are known in the art. Mascara is a cosmetic frequently used to enhance the appearance of a user's eyes by changing the appearance of the user's eyelashes. Mascara may be used to darken, thicken, lengthen, and/or define the eyelashes. It may be found in the form of a liquid, cake, or cream and it may contain pigments, oils, waxes, and preservatives. The pigmentation is often black in color and may include carbon black.

To apply mascara an applicator brush is typically used which includes a brush portion with outwardly extending bristles positioned at the end of an elongate applicator. Mascara that comes in the form of a liquid may be held in a container such as a bottle. The container may be an elongated housing, or a housing of any other shape. The container may have a cap that is configured to be secured to the container to cover the container opening. In many traditional mascara products, an elongate applicator with an applicator brush may be connected to the underside of the cap such that when a user inserts the applicator into the container and secures the cap to the container, the applicator brush is inserted into the mascara liquid in preparation for the next use. Traditionally, mascara is purchased in a small bottle or elongate container which is accompanied by a cap which often includes an elongate applicator attached to the underside of the cap. Once the applicator is removed from the container, the rear end of the cap usually acts as a handle for the user to grip while applying the mascara to the user's eyelashes.

The bottles, containers, and caps may vary widely in size and shape. The applicator and applicator brush must be appropriately sized for the container such that the brush reaches the bottom of the container when fully inserted in order to use of the mascara stored in the container. For this reason, the mascara container, cap, and applicator must be compatible in size and shape with each other in order to achieve an effective storage and mascara application system.

Mascara may be applied with an applicator brush using several steps. Once the applicator is removed from the container, a user may remove excess mascara from the applicator by rubbing or scraping the applicator brush against the inner lip of the container opening. The mascara may be applied by stroking the bristles of the brush on the bottom side of a user's upper lashes, stroking upward from the base to the ends of the upper lashes. The mascara may then be applied to the upper side of the lower lashes, stroking downward from the base to the ends of the lower lashes. Mascara may be applied to each lower lash using the bristles (or tip of the applicator), separating each lash from the others as the mascara is applied. A piece of tissue may be held between the face and the lashes to act as a background for the lower lashes, making them easier to see. Mascara may then be applied downward from the base to the end of the lower lash, using the tip of the applicator. Mascara may be applied in multiple thin coats, which might provide a more natural appearance than a single thicker coat. Each coating may be allowed to dry before the next coat is applied.

Applying mascara can be a tedious and time consuming process, and it is often difficult to achieve the desired results. The user must usually make multiple repetitive upward, downward, and side-to-side motions while holding the applicator in order to achieve sufficient separation, definition, thickening, and lengthening of the eyelashes. This leads to inconsistent results, and a tiresome and repetitive process for the user. A mascara applicator which rotates the brush portion of the applicator may assist the user in consistently and efficiently applying mascara to the user's eyelashes. Furthermore, a mascara applicator which oscillates from side-to-side may further assist the user to achieve the amount of desired eyelash separation and thickening without resorting to tiresome and repetitive movements.

A conventional mascara applicator system that applies the mascara in this fashion may include one or more applicators that rotate and/or vibrate, but the system may not include the user's preferred type of applicator, and/or it may be incompatible or inappropriate for a user's type of eyelash and/or type of mascara. The applicator brush may be at the end of an applicator that is too long or too short for use with a user's preferred mascara container. Furthermore, given that a user may frequently wish to switch between or replace their preferred mascara types, a user may frequently encounter problems with using the conventional system with widely varying applicators and applicator handles supplied with mascara containers.

SUMMARY OF THE INVENTION

Accordingly, in one embodiment an object of the present invention is to provide a cosmetic applicator system for mascara which is compatible with a wide variety of traditional manual mascara applicators (hereinafter, "brushes") and provides automated movement of the applicator to facilitate applying the mascara. Embodiments of the present invention may include an applicator system configured to receive and retain a wide variety of brushes. Embodiments of the present invention may also include a motor which may provide all or a combination of rotation, oscillation, or vibration movement of the brush. In some embodiments, the present invention may include buttons and/or other means for actuating the motor, controlling the rotational direction of the motor, and the speed of the rotation, oscillation, or vibration.

DESCRIPTION OF THE PREFERRED EMBODIMENT(S)

In general, various embodiments of a cosmetic or mascara applicator system in accordance with the present invention provide automated movement of the applicator to facilitate applying the mascara. The applicator system is preferably compatible with a wide variety of shapes and sizes of traditional brushes, i.e., caps and/or handles, which typically accompany bottles or containers of mascara. For the purposes of this disclosure, the rear of a cap and applicator combination may be referred to as the brush handle however it will be understood by those of ordinary skill in the art that the term "handle" may also refer to a cap/handle that is the handle of the brush and is the mascara container's cap and/or various non-cap handles of a brush. The grip unit may include an inner shell portion which defines a cavity configured to retain the brush therein.

In particular, embodiments of the applicator system may include a grip unit defining a cavity section for receiving the brush. The cavity section may include protruding flexible retaining members extending inwardly therein (into the cavity section), which are configured to flex and bend around the rear of the brush handle to retain it within the cavity section. The flexible retaining members may allow the cavity section to receive and retain a wide variety of shapes and sizes of brush handles. The cavity section may include a rotatable inner shell portion operably connected to a motor and a power source configured to provide one or a combination of rotational, oscillating, and/or vibrating movement to the brush handle retained within the cavity section.

Figure 1:
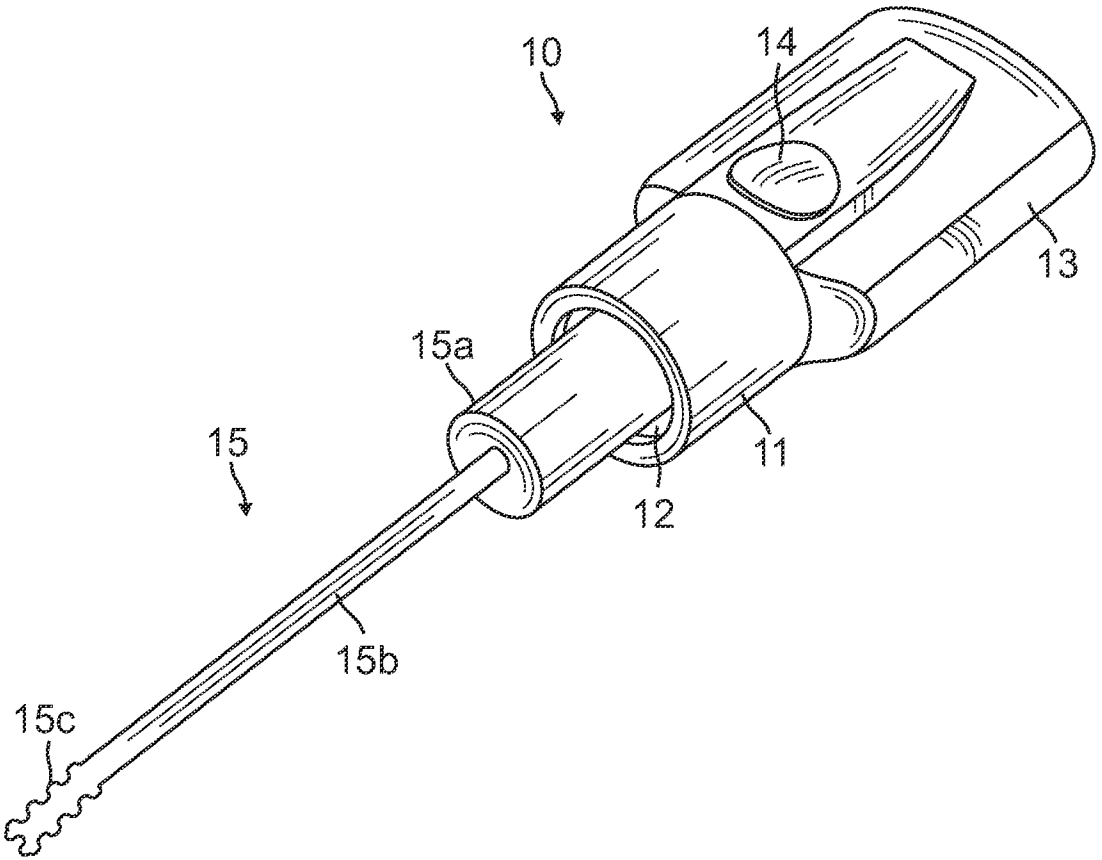
FIG. 1 is a perspective view of a mascara applicator system, according to a preferred embodiment.

Turning now to the drawings, FIG. 1 is a perspective view of an applicator system 10, according to an embodiment of the present invention. The applicator system includes a grip unit 11, a cavity section 12 within the grip unit, a housing unit 13, and a button 14. The applicator system is shown in FIG. 1 along with a mascara brush 15 which includes a handle 15*a* (which also may be but need not be a mascara container cap), a shaft portion 15*b*, and a bristle portion 15*c*. The rear of handle 15*a* has been inserted and secured within cavity section 12 such that applicator system 10 may be comfortably held by the user. Cavity section 12 may be sized to receive handles of a wide variety of sizes and shapes of brushes 15 such that shaft portion 15*b* and bristle portion 15*c* extend from grip unit 11.

Within housing unit 13, a motor (not depicted in FIG. 1) may be positioned to provide rotational power to cavity section 12 such that the brush 15 is rotated and/or axially oscillated to facilitate application of mascara to the user's eyelashes. In such an embodiment, a button 14, or a plurality of buttons, may allow the user to control aspects of the motor such as power on/off, rotational direction, rotational speed, and oscillation speed. Other embodiments may include a dial, scroll wheel, electronic display, touch screen, or a combination of any of these to control the motor.

Figure 2:
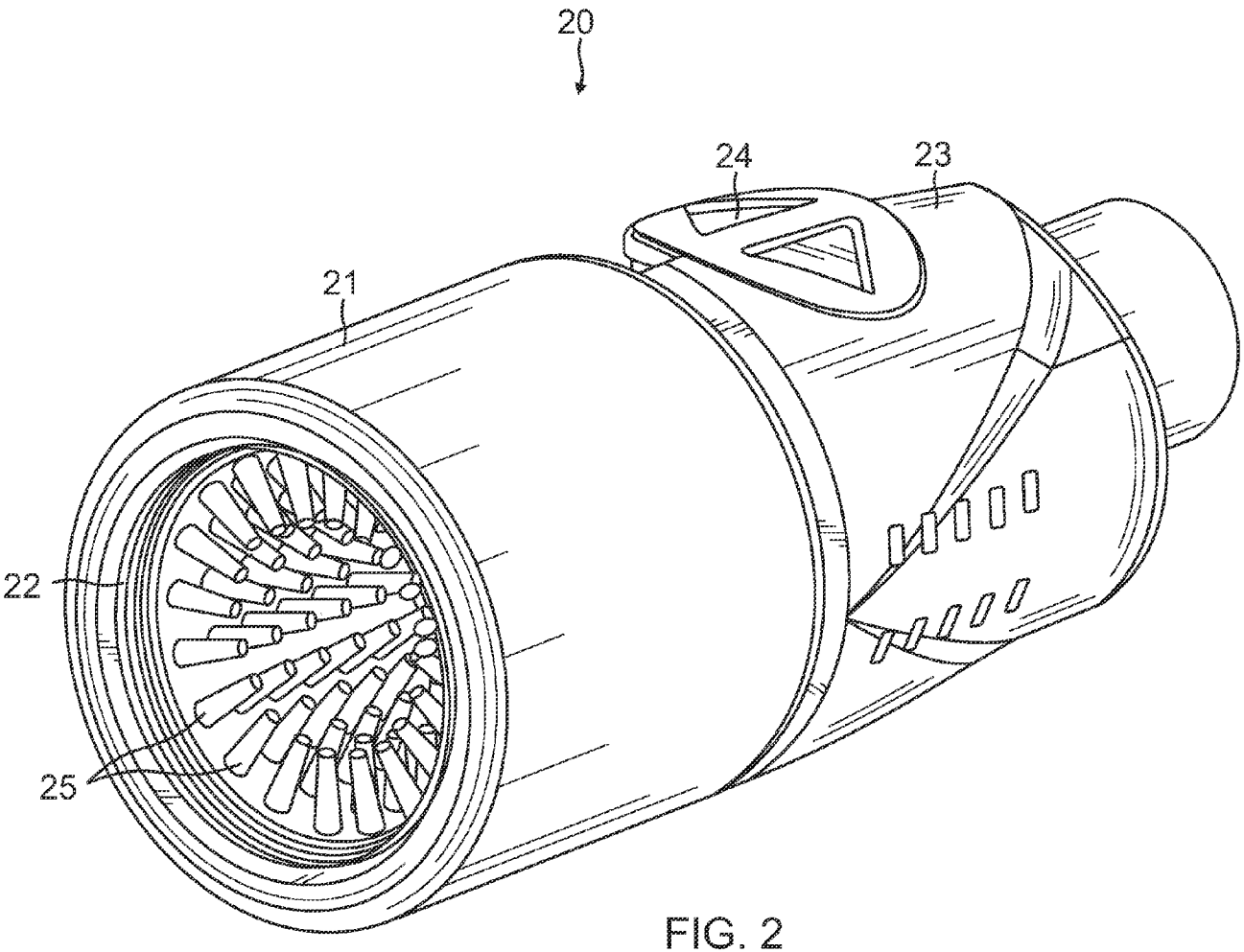
FIG. 2 is an additional perspective view of a mascara applicator system similar to that of FIG. 1 having a different shape for a housing unit and button.

FIG. 2 is another perspective view of an embodiment of the present invention. In this embodiment of mascara applicator system 20, a mascara brush is not included for the sake of clarity, while details of a grip unit 21, cavity section 22, housing unit 23, and buttons 24 are more visible. Within cavity section 22, there may be inwardly protruding flexible retaining members 25. The retaining members 25 may be resiliently flexible to permit the user to insert the applicator handle into a recess defined in cavity section 22. Retaining members 25 may extend radially inward from the surfaces defining the recess in cavity section 22 such that contact with the brush handle causes retaining members 25 to be deflected in a direction parallel to a central axis of the recess and cavity section 22 and away from an open end of the cavity section 22 while abutting the brush handle. The farther the brush handle is inserted into cavity section 22 of the applicator system, the more retaining members 25 may come into contact with the brush handle, providing greater friction to retain the handle therein. The retaining members 25 may further be sufficiently tactile and/or have a high enough friction coefficient to retain the handle within the cavity section 22 while the brush is oscillated and/or rotated relative to the mascara applicator system.

Embodiments of the invention may also include one or more buttons 24 to actuate the motor, and may include a plurality of buttons 24 to control and vary the movements produced by the motor, such as rotational direction, rotational speed, oscillation, and oscillation speed. The buttons 24 may be pressed to cause the brush held by the retaining members 25 within cavity section 22 to be rotated, oscillated, or rotated and oscillated. The oscillation may be from side to side, rather than a vibration.

Figure 3:
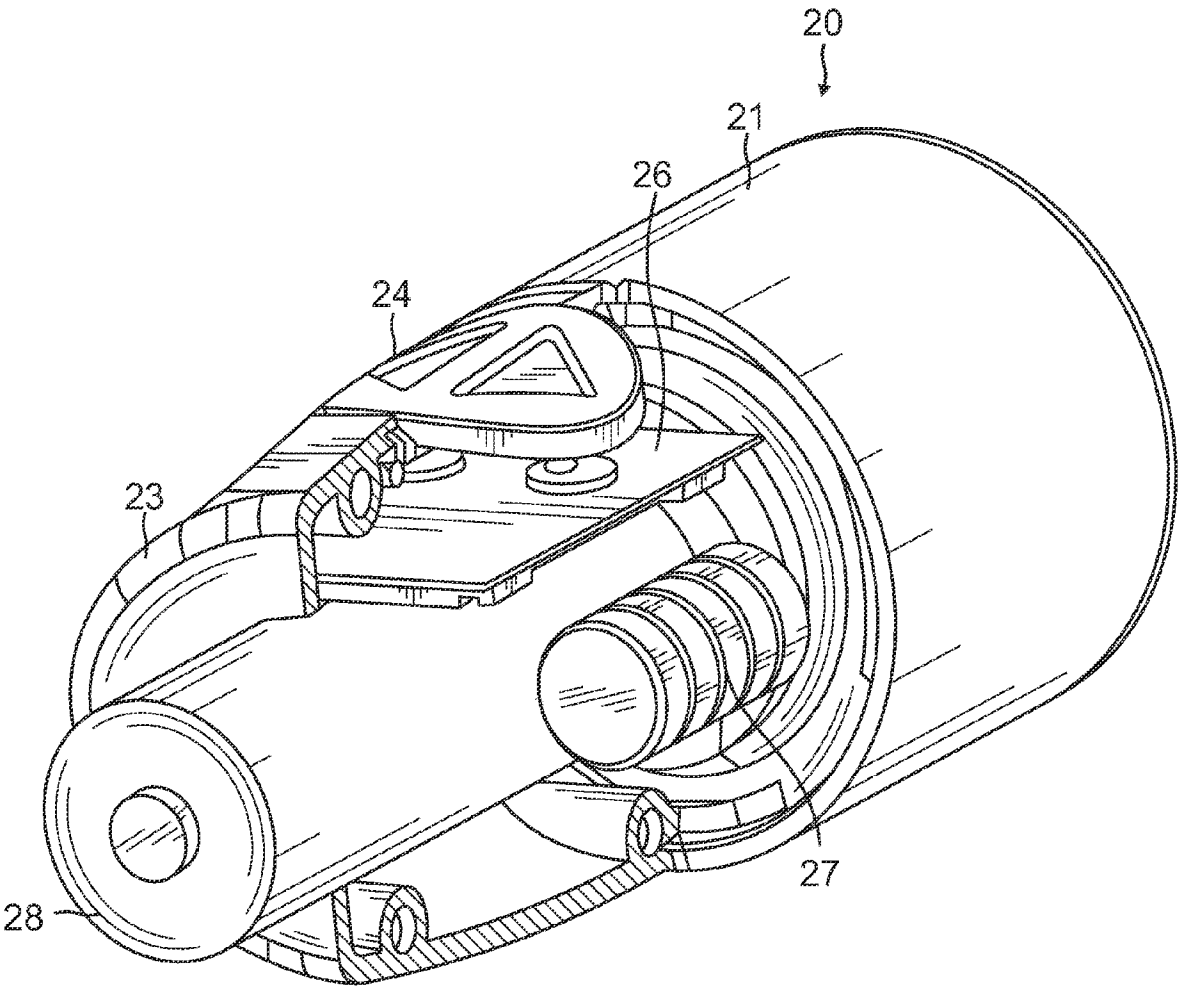
FIG. 3 is a partly assembled perspective view of the mascara applicator system of FIG. 2.

One or more of the buttons 24 may be held down continuously while the brush is being rotated or the button may be pressed and then released to activate rotation in a first rotational direction. One or more buttons 24 may then be pressed and released to activate rotation in a second rotational direction. In another embodiment, two or more buttons 24 may be used, with each button being used to control a direction of rotation of the brush. In another embodiment, the button 24 may have two sides (e.g., as shown in FIG. 3), with each side being capable of being depressed to cause the applicator to rotate in a corresponding direction.

In these embodiments, the user may open a container of mascara, removing the brush (e.g., the cap and attached brush combination) from the container. The user may insert the handle into cavity section 22 such that the brush is extending away from the cavity section. The user may then hold housing unit 23 and/or grip unit 21 to apply mascara to the user's eyelashes while mascara applicator system 20 oscillates and/or rotates the brush.

The rotational movement with respect to the longitudinal axis of the brush, i.e., clockwise and anti-clockwise movement, may be simple rotation in one direction (or selective rotation in one or the other direction depending on how the button or buttons operate the motor). The rotation could also oscillate, e.g., the rotational movement could be less than 360 degrees in each direction, but need not necessarily be less than 360 degrees.

More preferably, while one may selectively rotate the brush using the buttons, the brush also moves in a vibrating fashion, and most preferably in an oscillating fashion, along its longitudinal axis (as explained in more detail herein). Mascara applicator system 20 therefore provides the benefit of being able to work with the user's preferred mascara and/or brush white also providing the advantages of rotation, and/or oscillation while the user applies mascara.

FIG. 3 is an alternate rear perspective cutaway view of the applicator system embodiment of FIG. 2. FIG. 3 illustrates mascara applicator system 20 according to an embodiment that includes a housing unit 23, a grip unit 21, one or more buttons 24, a printed circuit board (PCB) 26, a battery unit 27, and a motor 28. FIG. 3 shows the mascara applicator system 20 with half of housing unit 23 removed to show components housed therein.

The circuitry may receive control signals from the buttons 24. The motor 28 may be mounted within the housing unit 23 and controlled by circuitry and/or programming of the circuitry of the PCB 26. The motor 28 may be operably connected to an inner shell portion (depicted in other drawings herein) of grip unit 21 to produce rotation and/or oscillating movement. The battery unit 27 may include one or more batteries that are disposed adjacent to each other. The motor 28 may or may not extend out of the rear end of housing unit 23 that is distal with respect to grip unit 21.

Figure 4:
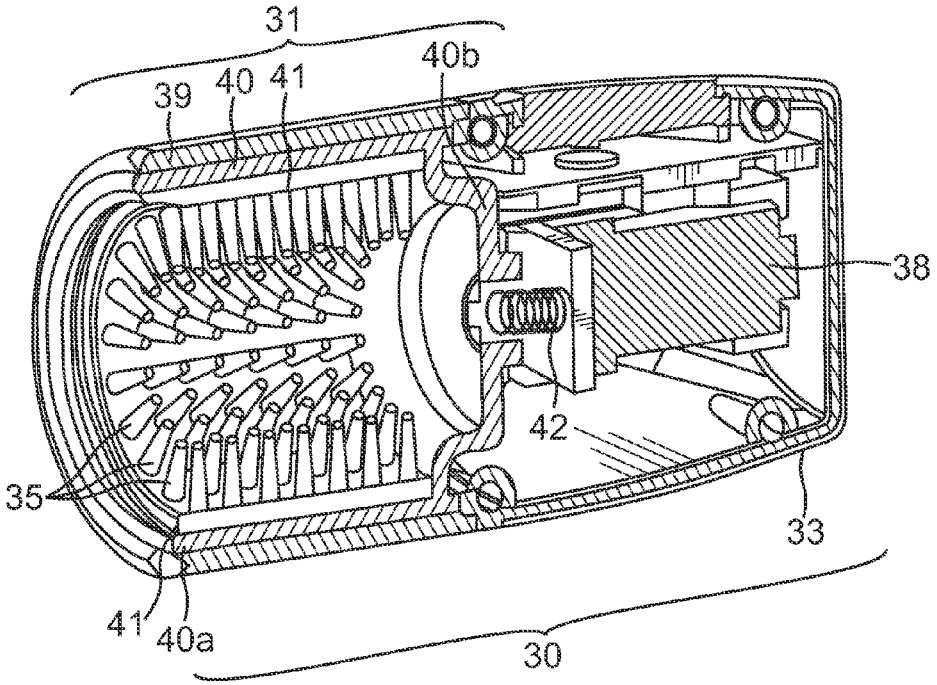
FIG. 4 is a perspective view of a section of the housing unit the mascara applicator system of FIG. 2.

FIG. 4 is a cross-sectional view of the mascara applicator system, according to another embodiment. Applicator system 30 may include a grip unit 31 and a housing unit n 33. The housing unit 33 may include a button 24 (FIGS. 2 and 3) and a motor 38. The grip unit 31 may include an outer shell 39, an inner shell 40 disposed fully within the outer shell, and a retaining liner 41 having a plurality of flexible retaining members 35. The inner shell 40 may have an inner wall 40*a* and an end wall 40*b*, and be rotatably disposed within outer shell 39. The inner shell may be used in any of the applicator system embodiments herein.

The inner shell 40 may be driven to rotate and/or oscillate by motor 38 which may be operably connected to an end wall 40*b* of inner shell 40. The oscillation may be from side to side, rather than a vibration. The end wall 40*b* and inner wall 40*a* of inner shell 40 may define a cavity in grip unit 31. The retaining liner 41 may be mounted on an inner surface of inner wall 40*a*, such that the flexible retaining members 35 extend radially inward towards the central longitudinal axis of grip unit 31.

In this embodiment, outer shell 39 at least partly surrounds inner shell 40 to prevent movement of the inner shell 40 radially away from the center axis of grip unit 31. The outer shell 39 is formed with a flange that extends from the outer shell radially towards the center axis of grip unit 31 to retain the inner shell 40 inside the grip unit 31 and to prevent the inner shell 40 from moving away from the housing unit 33. The flange retains the inner shell 40 against the motor and/or the housing unit.

In another embodiment, the outer shell 39 and the inner shell 40 may be secured together, and the outer shell and the inner shell may rotate together. In some embodiments, a biasing member 42 such as a spring may be included between housing unit 33 and inner shell 40 to bias inner shell 40 towards the opening of the cavity. In another embodiment, a biasing member may be included to bias inner shell 40 towards housing unit 33. Biasing member 42 may bias the position of inner shell 40 such that a cam surface of the lip of inner shell 40 remains in constant contact with the lip of outer shell 39, as discussed further herein.

Figure 5:
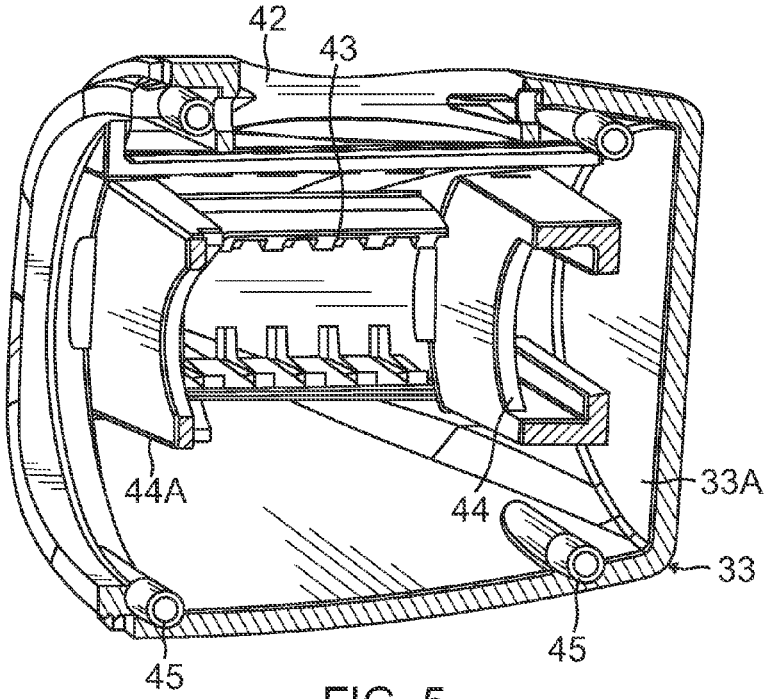
FIG. 5 is a perspective view of a section of an alternative version of a housing unit of the mascara applicator system of FIG. 2.

As shown in FIG. 5, a housing unit 33 has a housing which is formed, e.g., by a housing section 33A which may include a single aperture 42 for a button to extend through. The housing unit 33 may include a battery mount 43 for a plurality of batteries (such as watch-type batteries), and a pair of motor mounts 44, 44A for supporting a motor. A first end of the housing unit 33 may be formed with threads to engage with corresponding threads of an outer wall of a grip unit (not depicted in FIG. 5). Housing unit 33 would have a complementary housing section to housing section 33A which has projections to mate with openings 45 to help secure the housing sections together.

Figure 6:
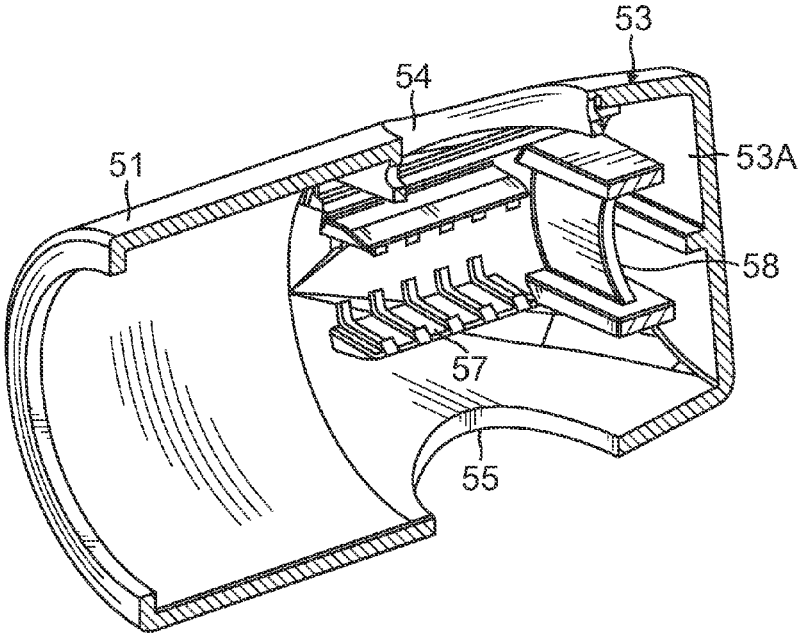
FIG. 6 is a perspective view of a section of another alternative version of a housing unit of the mascara applicator system of FIG. 2.

FIG. 6 is a perspective view of a section of an outer housing of an alternate embodiment of the mascara applicator system. Housing unit 53 has a section 53A (and a complementary section), and in this embodiment, grip unit 51 is integrally and/or unitarily formed. Housing unit 53 may include a first aperture 54 and a second aperture 55, a motor mount 58, and a battery mount 57. Battery mount 57 may be configured to hold a plurality of batteries adjacent to each other to form a battery unit. Motor mount 58 may be formed to support one end of a motor (not depicted). The first and second apertures 54, 55 may allow a first and second button (not depicted, but e.g., such as buttons 24 in FIG. 2), respectively, to extend through housing unit 53. The first and second buttons may actuate operation of the motor in a first and second rotational direction, respectively.

Figure 7:
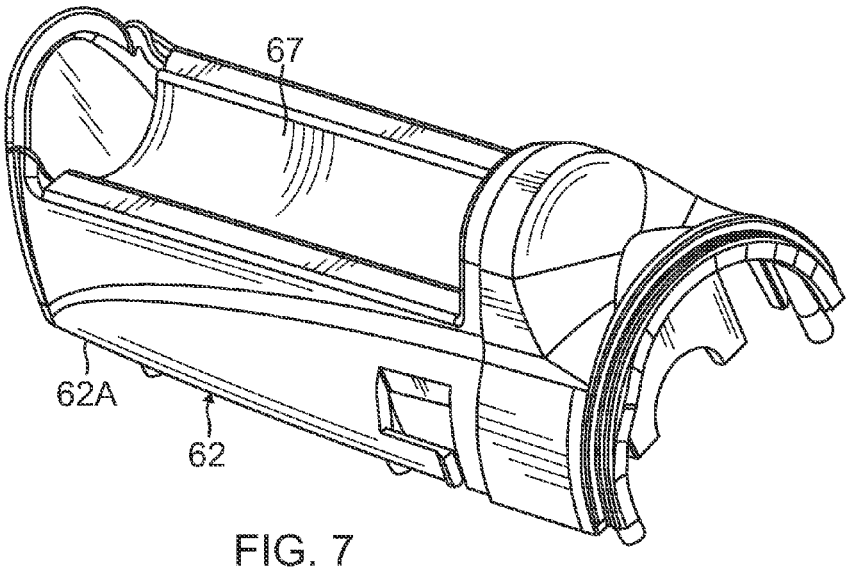
FIG. 7 is a perspective view of a section of a further alternative version of a housing unit of the mascara applicator system of FIG. 2.

FIG. 7 is a partial perspective view of yet another alternate embodiment of a housing unit for the mascara applicator system. Housing unit 62 may include a housing section 62A and a complementary housing section. Housing section 62A may have an externally accessible battery mount 67. Battery mount 67 may be configured to be covered by a removable battery cover (not depicted). Battery mount 67 may be configured to receive and draw power from a conventional size battery (e.g., AA, AAA, C, D, 9V, etc.). In an alternate embodiment, battery mount 67 may be configured to receive and draw power from a rechargeable battery, including batteries comprised of lithium ion (Li-ion), nickel metal hydride (NiMH), nickel-cadmium (NiCd), and/or lithium ion polymer (Li-ion polymer).

In these embodiments, battery mount 67 may be covered by a non-removable battery cover, or may be positioned within housing unit 62 in a position accessible by the user.

These embodiments may further include one or more recharging electrical contact points positioned on the exterior of housing unit 62, configured to draw power from a charging station with corresponding electrical contact points to provide recharging power to the rechargeable battery. In another embodiment, the applicator system includes an electrical socket into which a recharging cable may be plugged in, where the recharging cable draws power from the electrical grid via a standard power outlet.

Figure 8A:
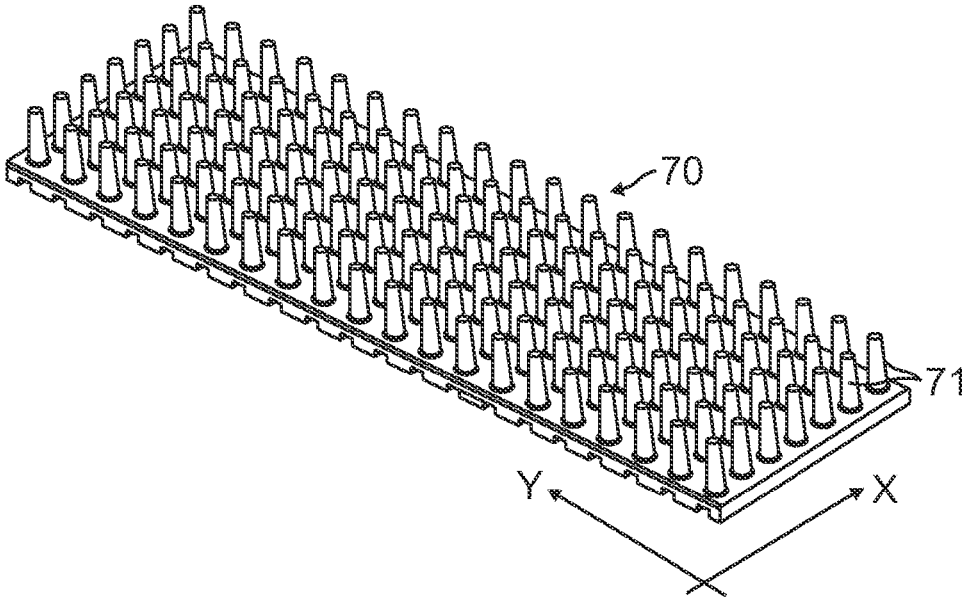
FIG. 8A is a perspective view of a gripping liner to be used in the housing for the mascara applicator system of FIG. 2, which view shows a surface of the gripping liner having protrusions.
Figure 8B:
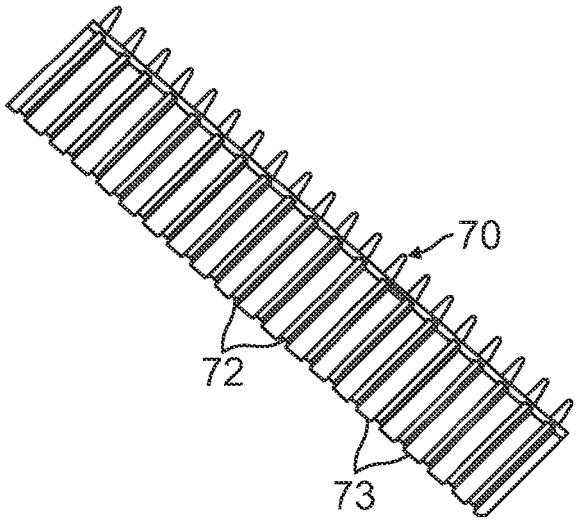
FIG. 8B is a perspective view of a surface of an opposite surface of the gripping liner shown in FIG. 8A.

FIGS. 8A and 8B are perspective views of a retaining liner 70 according to an embodiment. Retaining liner 70 has a first side and a second side and may be configured to line the inside surface of the cavity provided in the grip unit to retain a brush's handle (or cap acting as handle). FIG. 8A illustrates retaining liner 70 with a plurality of flexible retaining members 71 extending from a first side of retaining liner 70. FIG. 8B illustrates a second (opposite) side of retaining liner 70. The surface of the second side is formed with a series of alternating channels 72 and ridges 73. Channels 72 and ridges 73 may provide retaining liner 70 with sufficient flexibility and malleability such that it may be curved to form a circle shape around a first axis that is substantially parallel to the longitudinal direction of channels 72 and ridges 73. Channels 72 and ridges 73 may further provide retaining liner 70 with structural rigidity that resists bending about a second axis that is oriented perpendicularly to the longitudinal direction of channels 72 and ridges 73. Retaining liner 70 may be configured to be secured to the inside surface of the inner wall of the inner shell as discussed above in FIG. 4 such that the flexible retaining members 71 extend radially inward toward a center axis of the inner shell.

Figure 9C:
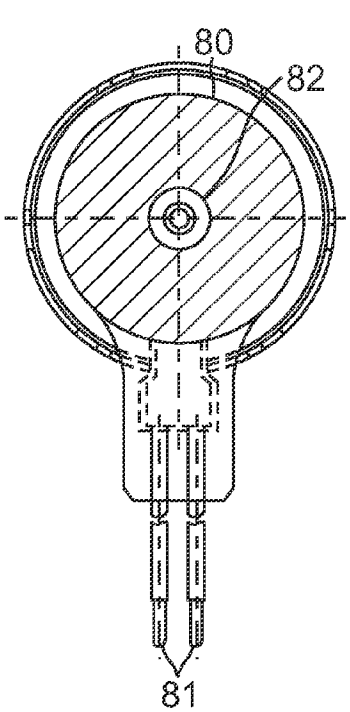
FIGS. 9A, 9B and 9C are various views of a motor for use in the mascara applicator system of FIG. 2.
Figure 9B:
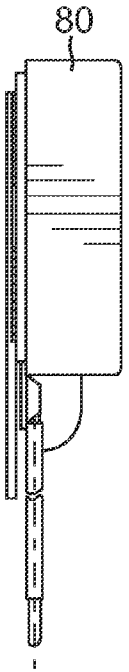
Figure 9A:
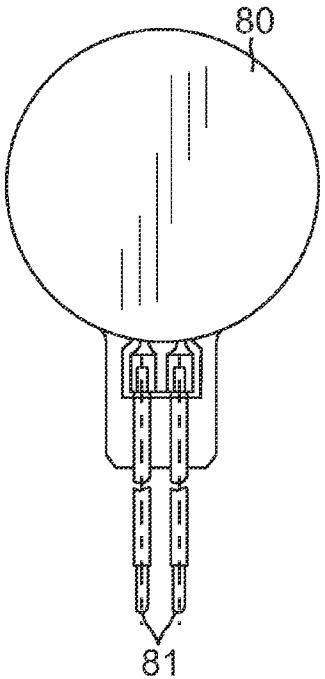

FIGS. 9A, 9B and 9C includes multiple views of a motor 80 configured to provide rotational and oscillation movement to the brush when in the mascara applicator system according to an embodiment of the present invention. Motor 80 may be activated for rotation in either direction in response to pressing one or more buttons down in either direction as previously discussed. The direction of the arrows on the buttons of the mascara applicator system preferably indicate the rotational direction of output drive shaft 82 of motor 80. In response to rotation of the output drive shaft, the inner shell and therefore the brush rotate in that same direction. In other embodiments, there may be one button which may cause rotation in only one direction, may toggle back and forth between directions, or just institute rotation that oscillates between the two directions.

Motor 80 includes leads 81 which provide electrical connection between motor 80 and the battery or other power source. Just for illustrative purposes only: the rated voltage of motor 80 may be 1.5V, plus or minus 1V; the rated current may be between 5 mA and 100 mA; the rated rpm may be between 2,000 and 30,000 rpm; and the starting voltage may be between 0.3 and 6V.

In a preferred embodiment, when motor 80 is rotating, an oscillation mechanism may be provided to create an axial oscillation motion of the inner shell along the axis of the mascara applicator system and the brush. The oscillation frequency, for example, may be between five and nine cycles per second, but could be more or less. In a more preferred embodiment, the oscillation frequency may be seven cycles per second. In a preferred embodiment, the oscillation pitch may be between 0.01 cm and 0.1 cm. In a more preferred embodiment, the oscillation pitch may be between 0.02 cm and 0.03 cm. In a most preferred embodiment, the oscillation pitch may be approximately 0.025 inch, but could also be anywhere from about 0.01 inch to 0.010 inch.

Figure 10:
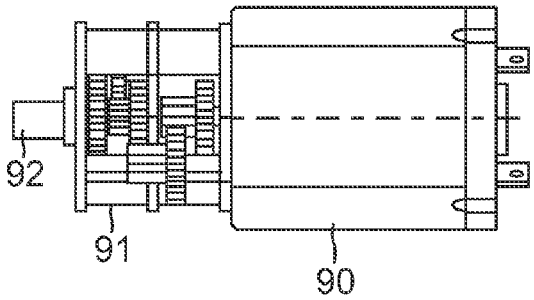
FIG. 10 is amide view of the motor showing its gears.

FIG. 10 is an illustration of one version of a motor and gear system, according to an embodiment of the present invention. Motor 90 and gear system 91 may have a length between one and five centimeters, and may be operably connected to an output drive shaft 92. The width and height of the rotation motor and gears may be between one half and two centimeters. The operating range may be between 0.2 and 10V. The no load speed may be between 16 and 1600 rpm at current ranging between 0.01 and 0.9 A. Output drive shaft 92 may be configured to transfer rotational power output from motor 90 and gear system 91 to the inner shell of the mascara applicator system. Gear system 91 may include a variety of different sized drive gears to control the speed of rotation output to output drive shaft 92. Gear system 91 may also be configured to provide rotational power to other driven gears operably connected to other components or aspects of the mascara application system.

Figure 11A:
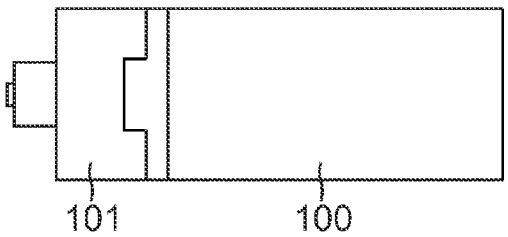
FIG. 11A is a schematic view of a motor which may be used in the mascara applicator system.

FIG. 11A is an illustration of a side view of a motor 100 and gear system 101 according to an alternate embodiment. The length of motor 100 and gear system 101 may be between 1 and 10 cm. The outer diameter of motor 100 and gear system 101 may be between 0.5 and 2 cm. Motor 100 may operate between 0.3 and 10V. The no load speed may be between 16 and 1600 rpm at current ranging between 0.01 and 0.9 A. The stall torque may be between 15 and 500 mNm at currents between 0.2 and 5 A. In one embodiment, there may be two motors, one for oscillation (rather than mechanical translation of one motor's rotation into axial oscillation) and one for rotation. In another embodiment, the motors may be replaced by one motor which can rotate and the axial oscillation is caused by mechanical means responsive to the rotation, which embodiment is most preferred.

Figure 11B:
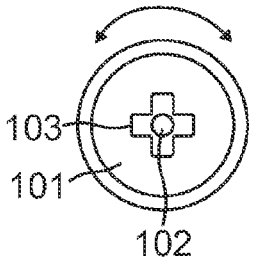
FIG. 11B is another schematic view of a motor from the axial direction for purposes of explaining rotational directions of the motor.

FIG. 11B is a view of the motor and gear system of FIG. 11A as seen from a view along the longitudinal axis of the motor. Gear system 101 is visible along with output drive shaft 102 which is configured to be operably mated to the inner shell to provide rotational power to the inner shell. Output drive shaft 102 may be configured to have a non-circular cross-sectional shape 103, such as shown in FIG. 11B, such that the drive shaft may be mated with a driven socket configured to have corresponding complementary shape for mating in order to produce effective transfer of rotational power.

Figure 12:
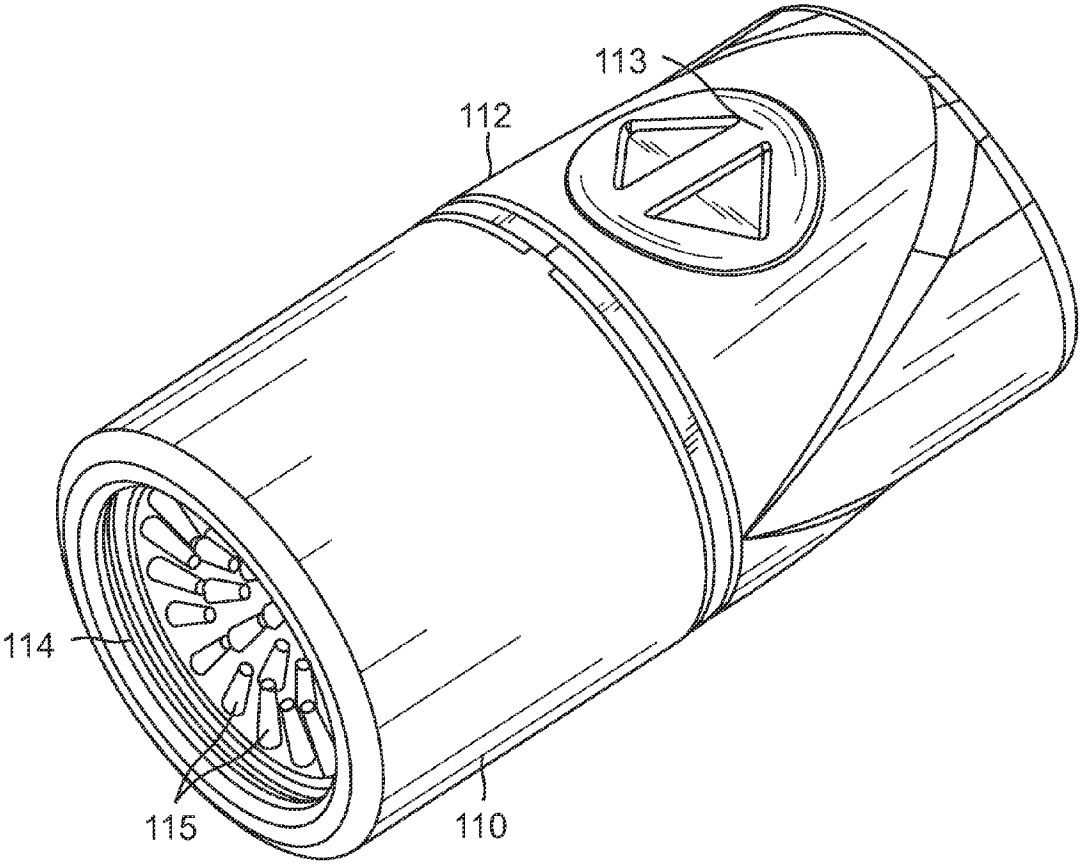
FIG. 12 is a perspective view of a portion of a mascara applicator system in accordance with another embodiment of the invention.

FIG. 12 is an alternative embodiment of a mascara applicator system which incorporates smaller components including the battery and motor in order to achieve a slimmer profile. The embodiment includes a grip unit 110, a housing unit 112, one or more buttons 113, a cavity 114 within the grip unit 111, and a plurality of flexible retaining members 115 to receive and retain a brush's handle.

Figure 13:
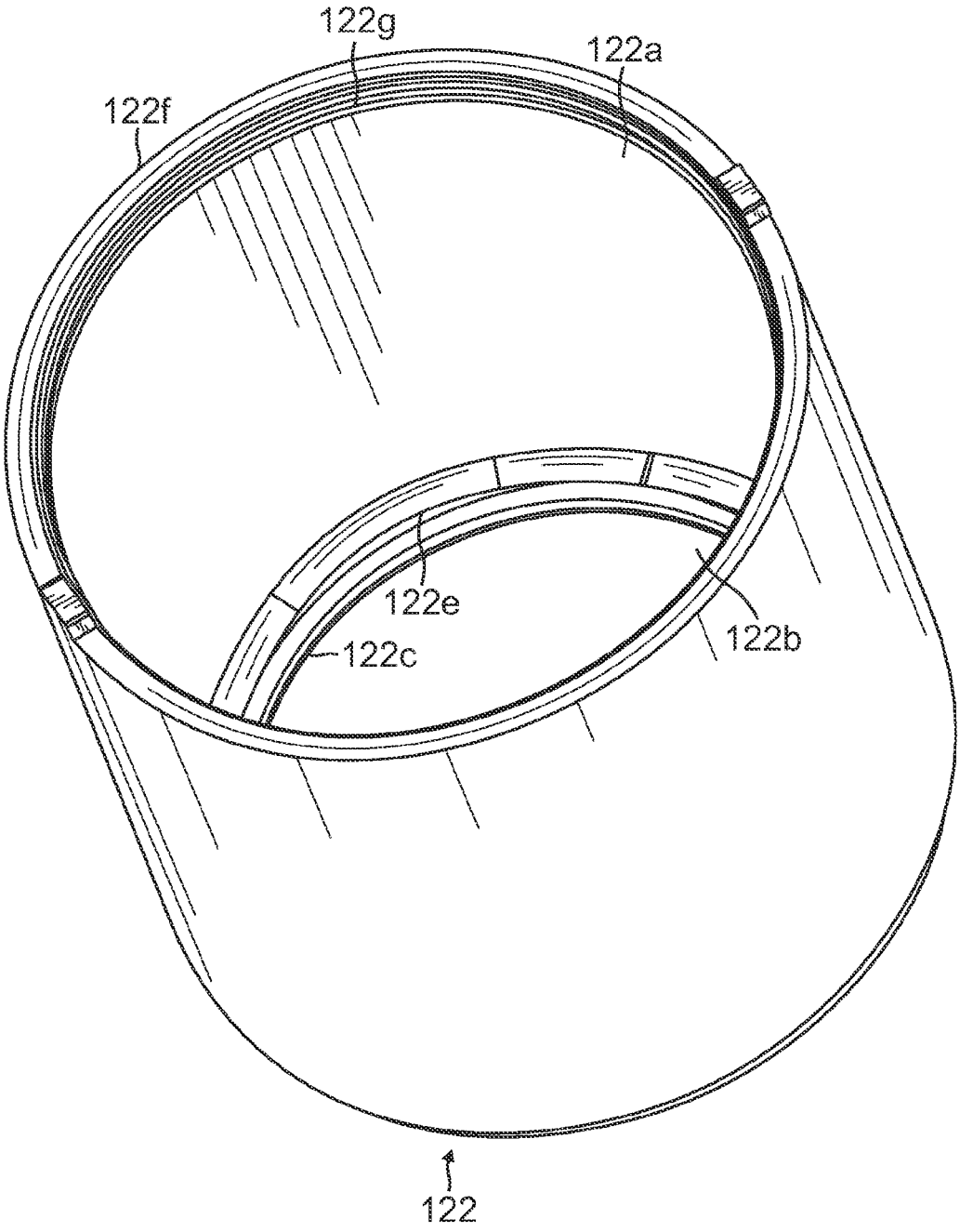
FIG. 13 is an enlarged perspective view of a grip unit outer shell of any embodiment of the mascara applicator system showing cam surfaces thereon.

With reference to FIGS. 13 to 17, the translation (conversion) of rotation of the motor's output drive shaft into axial oscillation (in addition to rotation) of the inner shell and therefore the brush disposed therein will be explained. In FIG. 13, grip unit outer shell 122 includes a first opening 122*a* and a second opening 122*b*, and further includes a first lip 122*c* proximate to second opening 122*b*. Lip 122*c* has a cam surface 122*e* facing first opening 122*a*. Preferably, lip 122*c* includes multiple cam surfaces, e.g. four offset at ninety degrees from each other. The variations in height of cam surfaces 1220 will dictate the range of oscillation in the axial direction.

Figure 16:
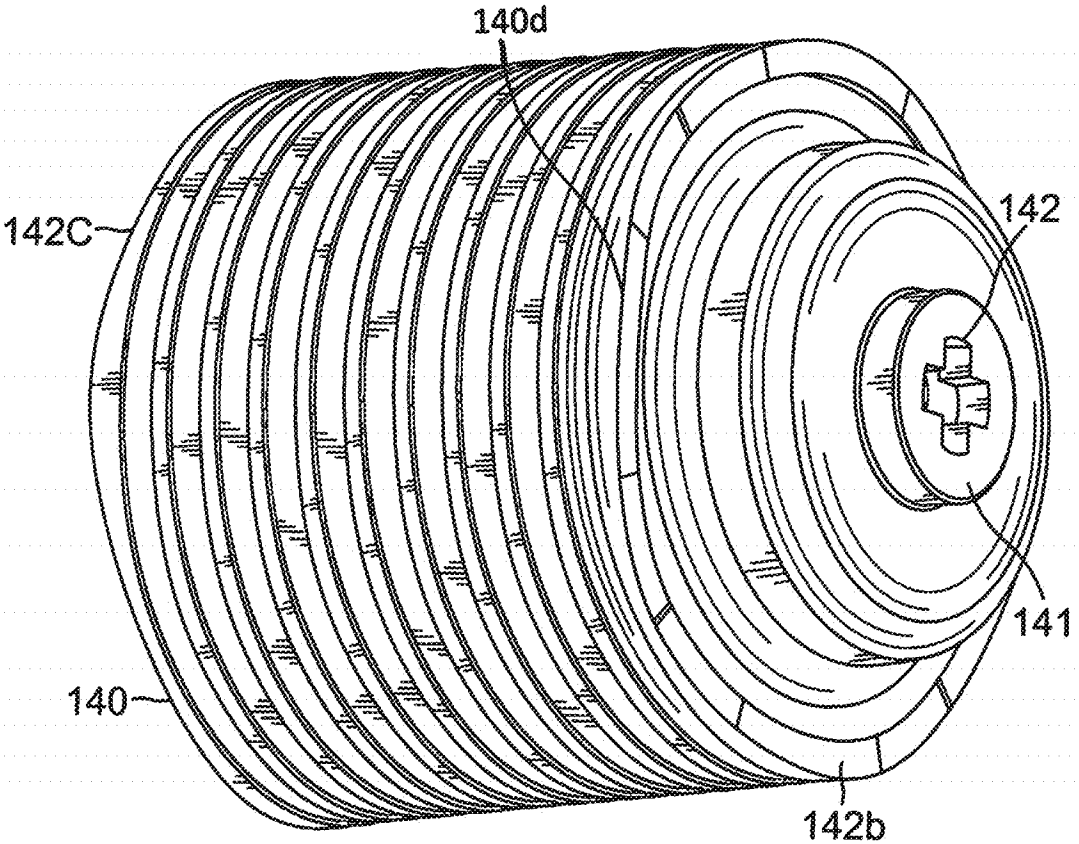
FIG. 16 is a perspective view from which a closed end of the inner shell of FIG. 15 having cam surfaces may be seen.

The inner shell (as shown in FIG. 16), nay include a cam surface 142*b* with a maximum height cam surface 142*c* which will abut cam surface maximum height portion 122*e* of lip 122*c* of outer shell 122. As the motor's output shaft is connected to the inner shell, inner shell 140 rotates within outer shell 122 while cam surface maximum height portion 142*c* of the inner shell 140 abuts and passes over cam surface 122*e* of 122*c* of outer shell 122. At a first alignment position during rotation of the inner shell, the maximum height of the cam surface of the inner shell tip and maximum height of cam surface 122*e* of lip 122*c* of outer shell 122 align to define an "outermost" position of the inner shell within outer shell 122. As the inner shell continues to rotate, the inner shell reaches a second position in which the lowest height of the cam surface of the inner shell lip and maximum height cam surface 122*e* of 122*c* of outer shell 122 align to define an "innermost" position of the inner shell within outer shell 122. The cam surfaces of both the inner shell and the outer shell are preferably smoothly mating curves so that the rotation of the inner shell and the motion of oscillation is smooth. In some embodiments, the system may include a biasing member (not depicted) which is configured to bias the inner shell toward cam surface 122*e* of outer shell 122 such that the cam surface of the inner shell and the cam surface of the outer shell are in constant contact as the inner shell is rotated within the outer shell.

Figure 14:
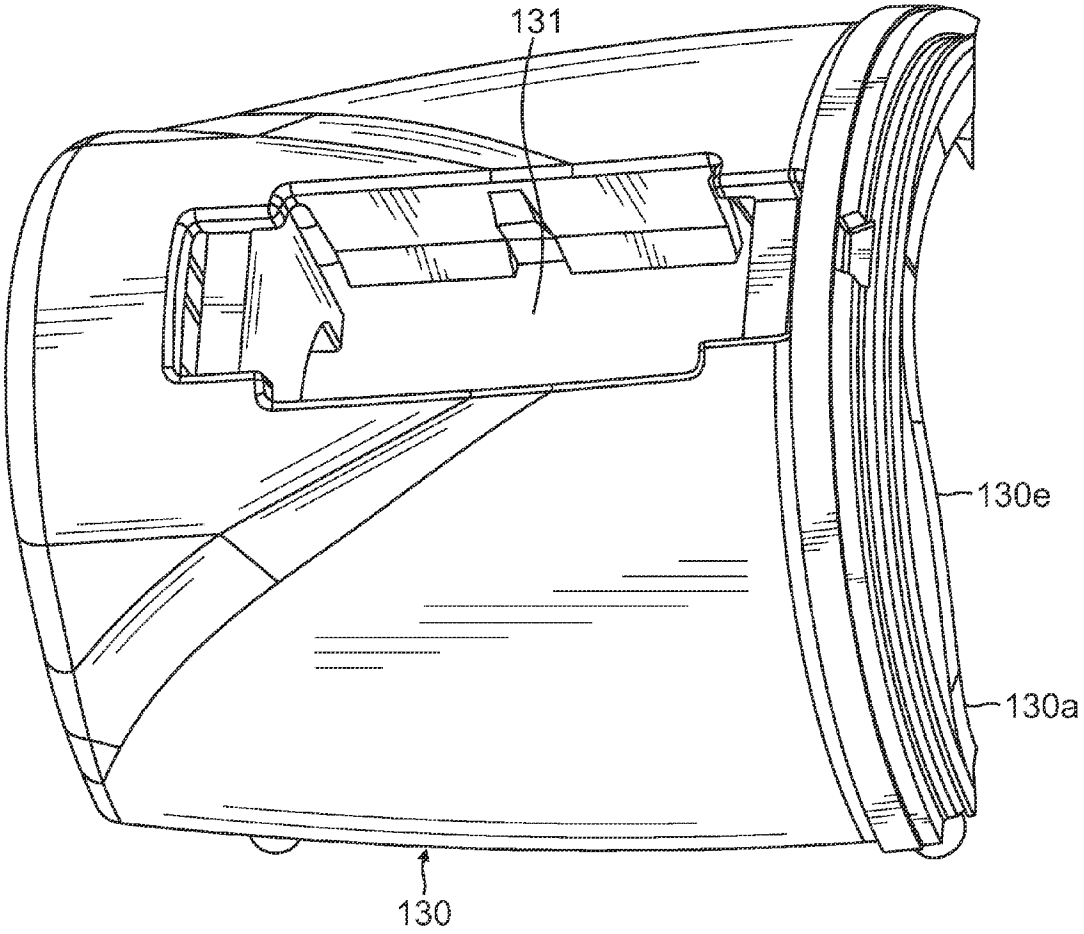
FIG. 14 is another enlarged perspective view of a portion of a section of the housing unit of any embodiment of the mascara applicator system showing the cam surfaces thereon.

FIG. 14 shows a perspective view of a partial housing unit of another embodiment. In this embodiment, a lip 130*a* of housing unit 130 proximate the inner shell includes a cam surface 130*e* configured to correspond and align with the ca surface of the inner shell to produce an oscillating movement of the inner shell as it is rotated by the motor. Some embodiments may also include a biasing member (not depicted) to bias the inner shell toward cam surface 1300 of the housing unit such that the cam surfaces are in constant contact as the inner shell is rotated within the outer shell. These two sets of cam surfaces should be properly aligned and calibrated so that the oscillation is smooth (i.e., preferably 180 degrees out of phase an that when the innermost set of cam surfaces are at their highest point the outermost cam surfaces are at mating position and vice versa. This minimizing rattling and enables the outer housing to be fixed. An aperture 131 is shown to provide access to install and remove a battery power source for the motor.

Figure 15:
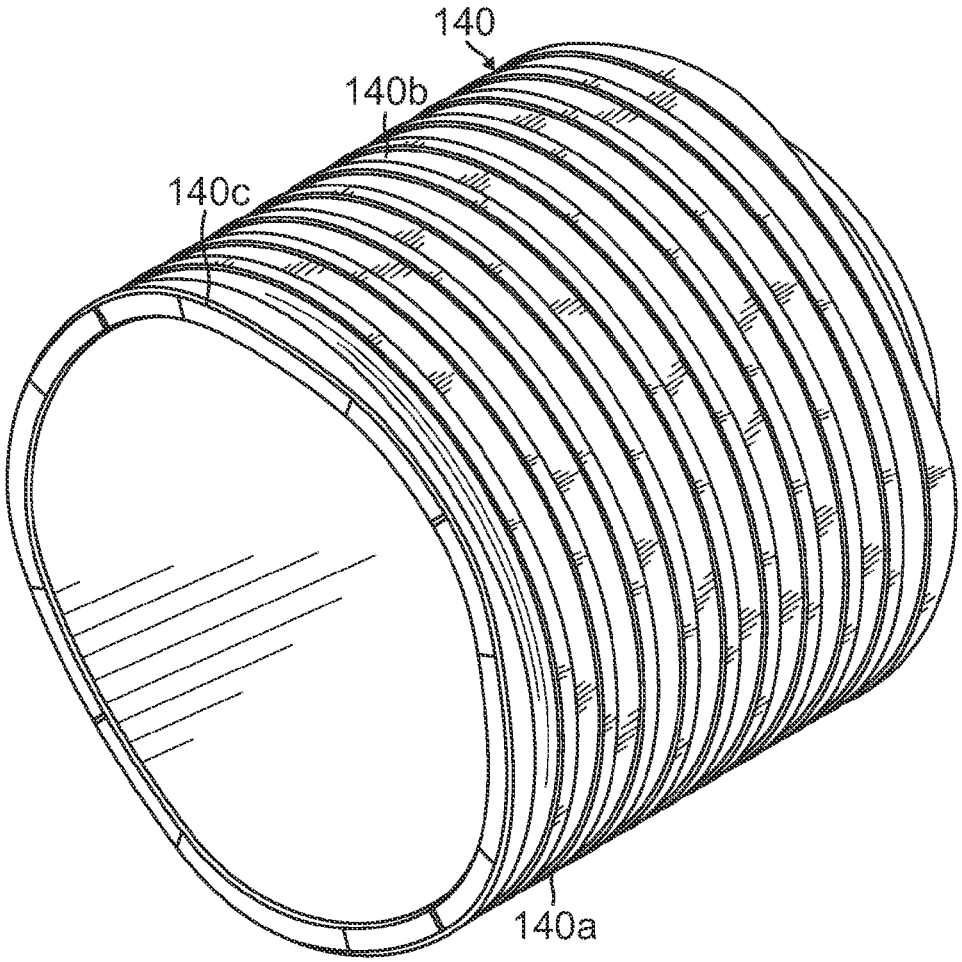
FIG. 15 is a perspective view from which an open end of an inner shell of the mascara applicator system of any embodiment having cam surfaces may be seen.

FIG. 15 is a perspective view of an embodiment of inner shell 140. In the depicted embodiment, inner shell 140 may include an outer surface 140*a* with raised ridges 140*b* configured to enable the inner shell 140 to freely rotate and oscillate within the outer shell. Inner shell 140 may include two cam surfaces 140*c*, one on each end of inner shell 140. In such an embodiment, the outer shell may also include two matching cam surfaces, one on each end of the outer shell, preferably on a lip positioned at each end of the outer shell. In another embodiment, the outer shell may include one cam surface on the lip positioned distal from the housing unit, and the housing unit may include a cam surface on a lip positioned proximate inner shell 140.

FIG. 16 is an alternate perspective view of the embodiment of the inner shell as shown in FIG. 15. Dual cam surfaces 142*c* of inner shell 140 are visible in FIG. 16. Inner shell 140 also includes a drive coupling 141 configured to translate rotational power from the output drive shaft of the motor to rotation of inner shell 140 within the outer shell. Drive coupling 141 on inner shell 140 may be configured with a driven socket 142 with a non-circular cross-section shape, such as a plus-shape as shown in FIG. 16, such that drive coupling 141 may be mated with an output drive shaft with an opposing corresponding shape in order to produce effective transfer of rotational power to inner shell 140. Drive coupling 141 of inner shell 140 is preferably a rigid, smooth, low friction surface so that inner shell 140 may freely move axially with respect to the motor shaft and the splines. The depth of drive socket 142 of the drive coupling 141 should be sufficient to accommodate the oscillation.

In the above discussion, the components depicted in FIGS. 13 to 16 have been discussed as various components of different embodiments of the applicator system. However in a preferred embodiment, the components of FIGS. 13 to 16 may be combined together form a single embodiment of the applicator system. For the purposes of this embodiment, references to a forward or front end of the applicator system and its components shall refer to the end proximate to the cavity opening and the mascara brush retained therein, and references to a rearward or rear end shall refer to the end proximate to the housing unit of the applicator system.

Outer shell 122 of FIG. 13 includes a second lip 122*f* proximate to first opening 122*a*. Second lip 122*f* may be threaded such that outer shell 122 can be threaded to threaded lip 130*a* of housing unit 130 (as depicted in FIG. 14). Inner shell 140 (depicted in FIGS. 15 and 16) may be inserted into the outer shell 122 prior to threading the outer shell to the housing unit. Once connected, the longitudinal movement of the inner shell is limited within the outer shell by front lip 122*c* of the outer shell (due to the inner diameter thereof being greater than the outer diameter of the inner shell at that end), and front lip 130*a* of the housing unit. Front lip 122*c* of outer shell 122 and front lip 130*a* of housing unit 130 may both include cam surfaces 122*e*, 130*e* respectively, which oppose each other when the outer shell and housing unit are connected. These cam surfaces 122*e*, 130*e* correspond or substantially correspond in diameter and align with cam surfaces 142*c* of inner shell 140.

As inner shell 140 is rotated within outer shell 122 by a motor positioned within housing unit 130, cam surfaces 142*c* of inner shell 140 may contact and pass over cam surfaces 122*e*, 130*e* of outer shell 122 and housing unit 130. Cam surfaces 122*e*, 130*e* may be configured such that inner shell 140 oscillates longitudinally within outer shell 122 between a first front-most position and a second rear-most position. In this embodiment, opposing cam surfaces 122*e*, 130*f* act to oscillate inner shell 140 back and forth and no biasing member is necessary to bias inner shell 140 towards a particular cam surface.

Figure 17C:
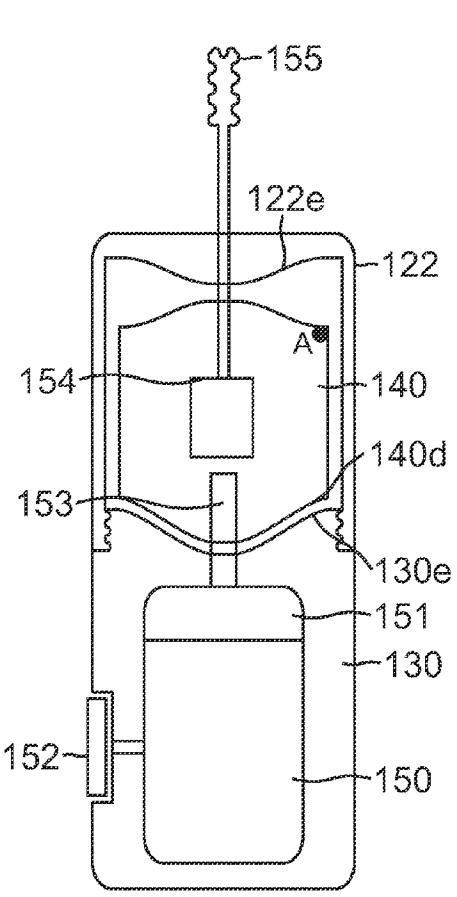
FIGS. 17A, 17B and 17C are schematic sectional views of the inner shell, outer shell, motor output shaft and a portion of the housing unit for purposes of further explaining the rotational and translational movement of the inner shell.
Figure 17B:
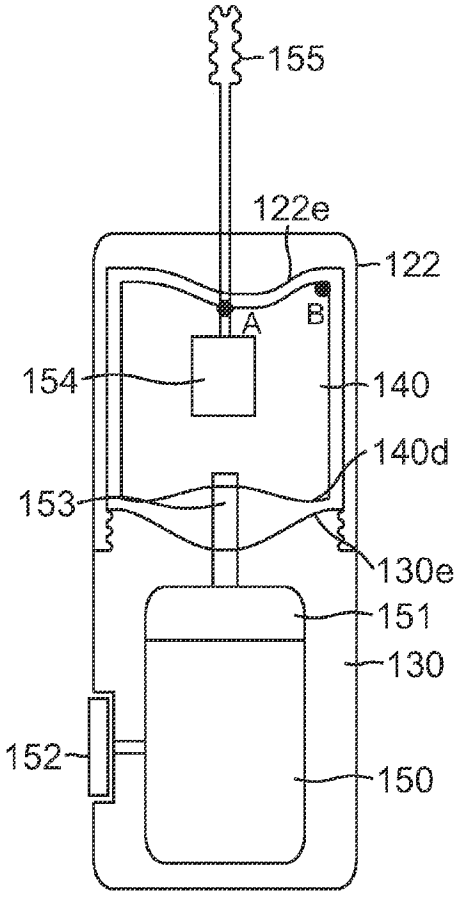
Figure 17A:
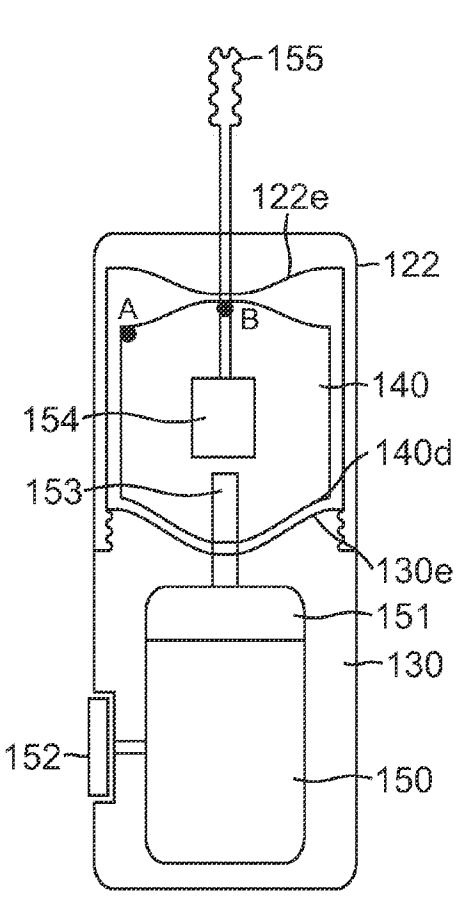

FIGS. 17A, 17B, and 17C are schematic diagrams representing the components of the embodiment discussed above showing the oscillation of inner shell 140 produced by the cam surfaces 122*e*, 130*e* of the outer shell 122 and housing unit 130. In these views, motor 150, gear system 151, button 152, and drive shaft 153 are also visible. A cap handle 154 of a mascara brush is also shown retained within the cavity of inner shell 140. Cam surface 130*e* of housing unit 130 opposes cam surface 122*e* of outer shell 122. Inner shell 140 is operably mated to drive shaft 153 which produces rotation of the inner shell within the outer shell. As inner shell 140 is rotated, rear cam surface 140*d* contacts and passes over cam surface 122*e* of the housing unit, and front cam surface 142*c* of the inner shell contacts and passes over cam surface 122*e* of the outer shell. The cam surfaces of the inner shell, outer shell, and housing unit 142*c*, 140*d*, 122*e*, 130*e* are configured such that the cam surface of the inner shell perfectly mates with only one of the cam surfaces of the outer shell and housing unit at any single moment during the rotation. Therefore, if a point of maximum height on front cam surface 142*c* of the inner shell is aligned with a point of minimum height on cam surface 122*e* of outer shell 122, a point of maximum height on rear cam surface 140*d* of the inner shell is aligned with a point of maximum height on cam surface 130*e* of housing unit 130*e* to define a front-most position of inner shell 140 during its oscillation movement.

The rotation of the inner shell is depicted in FIGS. 17A to 17C. A mascara brush 155 and handle 154 are also represented in the figures. Two positions on the cam surface of inner shell 140 are identified as point A and point B for purposes of this discussion. Point A represents a point of minimum height of cam surface 140*c* of inner shell 140 and point B represents a point of maximum height. In FIG. 17A, point A begins the rotational phase separated from cam surface 122*e* of outer shell 122 point B abuts a point of maximum height on cam surface 122*e* of outer shell 122. This effectively positions inner shell 140 in a rear-most position within outer shell 122. As the inner shell is rotated by the drive shaft of motor 150 (in a direction such that points A and B are moving from left to right in FIGS. 17A to 17C), cam surface 130*e* of housing unit 130 contacts rear cam surface 140*d* of inner shell 140 and forces the inner shell in a forward direction toward cam surface 122*e* of outer shell 122. FIG. 17B shows the positioning of the inner shell after a one-quarter rotation of the inner shell. This positions the inner shell 140 in a forward-most position within outer shell 122. In this position, point A and point B are aligned with a point of maximum height and minimum height of the cam surface 122*e* of the outer shell 122, respectively. The position of cap handle 154 retained within the cavity of inner shell 140 can also be seen shifted in a forward direction from the position depicted in FIG. 17A.

FIG. 17C shows the inner shell after a or e-quarter rotation following FIG. 17B. During the rotation, inner shell 140 has been forced in a rearward direction toward cam surface 130*e* of housing unit 130 to return to the rear-most position of inner shell 140 within outer shell 122. The position of cap handle 154 has also returned to the rear-most position shown in FIGS. 17A and 17C.

Figure 18A:
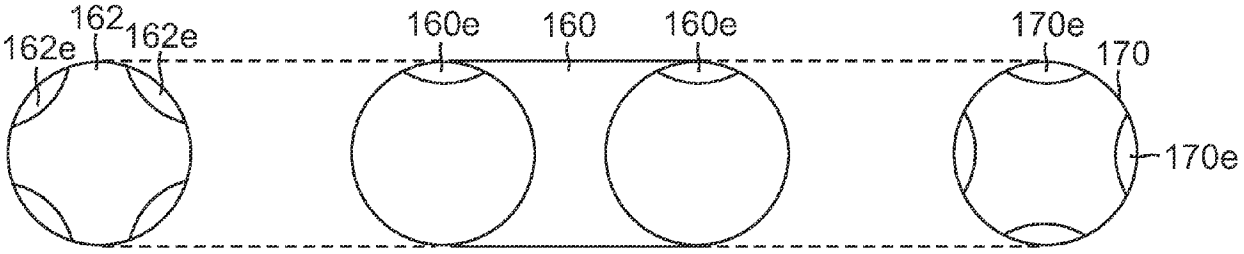
FIGS. 18A, 18B and 18C are schematic views of the inner shell, and portions of the housing and outer shell at the cam surfaces fir purposes of explanation.
Figure 18B:
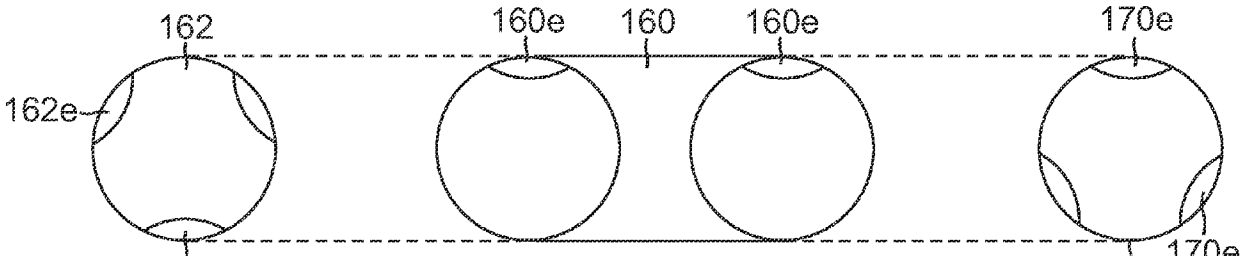
Figure 18C:
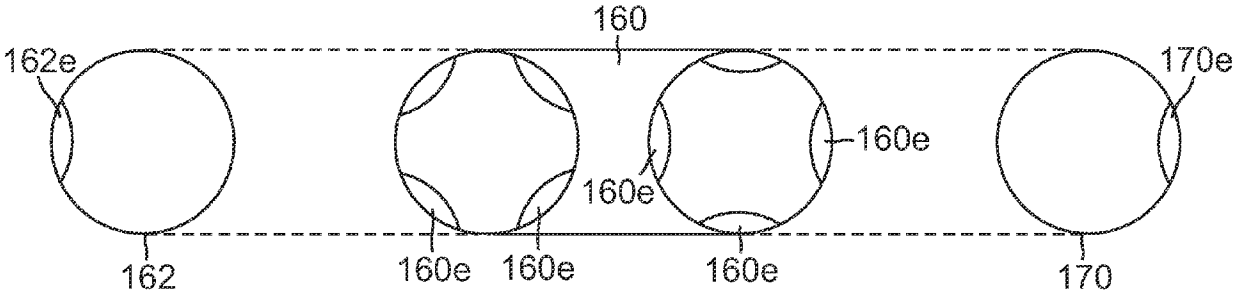

The number of cam surfaces and their positions around the lips may vary anywhere from one or more. FIGS. 18A, 18B, and 18C show representations of the lips of inner shell 160, outer shell 162, and housing unit 170 as they would align in alternate embodiments of the system. The placement and alignment of cam surfaces 160*e*, 162, 170*e* of inner shell 160, outer shell 162, and housing unit 170, respectively, are also represented. Preferably, there are one or two cam surfaces on each of the housing and the outer shell, positioned at complementary points around the annular lips, respectively, e.g., if there is one cam surface on each, then the cam surface on the lip of the outer shell is preferably 180 degrees apart from the cam surface (maximum height) on the housing, as shown in FIG. 18C.

If there are two cam surfaces on each then the cam surfaces on the lip of the outer shell are preferably 180 degrees apart from each other, and the cam surfaces on the housing are also preferably 180 degrees apart from each other and ninety degrees out of phase with the cam surfaces on the outer shell. In FIG. 18A, each lip of inner shell 160 includes one cam surface 160*e* aligned with one another along a longitudinal axis parallel to inner shell 160. The lip of outer shell 162 includes four cam surfaces which are positioned to be out of phase with the four cam surfaces of housing unit 170 by preferably 45 degrees. If there are three cam surfaces on the housing and the outer shell as shown in FIG. 18B, then the three cam surfaces on each are preferably 120 degrees apart and preferably 60 degrees out of phase with the cam surfaces on the other. There need only be one cam surface on each lip of the inner shell at the same rotational position.

Alternatively, the earn surfaces of the housing and the outer shell may be in phase, and the cam surface on the inner end of the inner shell may be out of phase with the cam surface on the outer end of the inner shell.

Alternatively, there may be one cam surface on the housing and one on the outer shell, and one or more cam surfaces on each end of the inner shell.

Thus, it is preferable, although not required, that the cam surface(s) on the relationship of i.e., points of contact of the maximum height portions of the opposing cam surface(s) on the outer shell and inner shell be diametrically out of phase with the relationship of i.e., points of contact of the maximum height portions of the opposing earn surface(s) on the inner shell and the housing, so that oscillation occurs.

Utilizing this configuration of the cam surfaces of the inner shell, outer shell, and housing unit, the applicator system produces a longitudinal, i.e., axial oscillation of the inner shell and the mascara brush retained therein. With the preferred structure, only one motor is required to provide power to rotate and axially oscillate the mascara applicator and brush combination. This motion will enable lifting and lengthening of the user's eyelashes (by the rotation in a direction away from the base of the eyelash) and separation of the lashes (by the axial oscillation of the brush). The system of the present invention is also universal in that it may hold mascara cap and brush combinations having caps/handles in a wide range of sizes corresponding to a cap/handle diameter variance.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A mascara applicator system, comprising:

a housing unit;

a grip unit connected to the housing unit and including an inner portion defining a cavity configured to receive and retain a handle of a mascara brush;

a motor mounted to the housing unit;

a means for controlling the motor;

a power supply for the motor;

the motor connected to the inner portion for rotating the inner portion of the grip unit to rotate the mascara brush; and means on the housing unit and on the inner portion for translating rotation of the motor into axial movement of the inner portion.

2. The mascara applicator system of claim 1 wherein the inner portion is configured with a first open end and a second closed end, the first open end defining the cavity, and the grip unit further comprising an outer shell member, the inner portion being disposed within the outer shell for rotating and moving translationally with respect to the outer shell member.

3. The mascara applicator system of claim 2 wherein the means for translating rotation of the motor into axial movement is a cam surface system comprising opposing cam surfaces on the housing unit and inner portion configured to align with at least one cam surface on the inner portion as the inner portion is rotated by the motor.

4. The mascara applicator system of claim 2 wherein the means for translating rotation of the motor into axial movement is a cam surface system comprising a cam surface on the housing unit configured to align with a cam surface on the inner portion as the inner portion is rotated by the motor.

5. The mascara applicator system of claim 4, wherein contact points of the cam surface on the housing unit and the cam surface which is on a first end of the inner portion are configured to be out of phase with contact points of a cam surface on the outer shell and a cam surface on a second end of the inner portion.

6. The mascara applicator system of claim 4, further comprising:

a biasing member configured to bias the inner portion such that the cam surface of the inner portion and the cam surface of the housing unit are in constant contact with one another while the inner portion is being rotated by the motor.

7. The mascara applicator system of claim 6, wherein contact points of the cam surface on the housing unit and the cam surface which is on a first end of the inner portion are configured to be diametrically out of phase with contact points of a cam surface on the outer shell and a cam surface on a second end of the inner portion.

8. The mascara applicator system of claim 2 wherein the means for translating rotation of the motor into axial movement is a cam surface system comprising a cam surface on the grip unit configured to align with a cam surface on the inner portion as the inner portion is rotated by the motor.

9. The mascara applicator system of claim 8, further comprising:

a biasing member configured to bias the inner portion such that the cam surface of the inner portion and the cam surface of the grip unit are in constant contact with one another while the inner portion is being rotated by the motor.

10. The mascara applicator system of claim 2, wherein the inner portion includes a drive coupling configured to mate with an output drive shaft connected to the motor.

11. The mascara applicator system of claim 1, further comprising:

a retaining liner comprising flexible retaining members, said retaining liner secured to an inner surface of the inner portion, wherein the flexible retaining members are for providing frictional retention of the handle of the mascara brush within the cavity.

12. The mascara applicator system of claim 1, wherein said means for controlling the motor comprises at least one button.

13. A mascara applicator system, comprising:

a motor;

a power source configured to provide power to the motor;

a grip unit comprising a cavity defined by an inner portion of the grip unit, said cavity comprising a retaining liner comprising a plurality of flexible retaining members;

said flexible and may be composed of a tactile rubber material retaining members configured to receive and frictionally retain the rear of a mascara applicator handle;

wherein the motor is configured to rotate the inner portion independent of the grip unit while the retaining liner retains the mascara applicator handle.

14. The mascara applicator system of claim 13 further comprising a means for translating the rotation of the motor into an axial movement of the inner portion parallel to the axis of rotation of the motor.

15. The mascara applicator system of claim 13 wherein the flexible retaining members extend radially inward from a first side of the retaining liner towards the central longitudinal axis of grip unit.

16. The mascara applicator system of claim 13 wherein the flexible retaining members are composed of a tactile flexible rubber material.

17. The mascara applicator system of claim 13 further comprising at least one button configured to actuate the motor.

18. The mascara applicator system of claim 13 wherein the power source comprises one of a replaceable battery and a rechargeable battery.

19. A mascara applicator system, comprising:

a housing unit;

a grip unit connected to the housing unit and including an outer shell and an inner shell defining a cavity configured to receive and retain a handle of a mascara brush;

a motor mounted to the housing unit;

a means for controlling the motor;

a power supply for the motor;

the motor connected to the grip unit for rotating the inner shell with respect to the outer shell to rotate the mascara brush; and at least one cam surface on the outer shell and on an opposing portion of the inner shell for translating rotation of the motor into axial movement of the inner portion.

20. The mascara applicator system of claim 19, further comprising:

a retaining liner comprising flexible retaining members, said retaining liner secured to an inner surface of the inner portion to provide frictional retention of the handle of the mascara brush within the cavity.

* * * * *